United States Patent [19]

Kaiser et al.

[11] 4,430,832

[45] Feb. 14, 1984

[54] FLOOR SEALING GASKET

[75] Inventors: Kenneth L. Kaiser; William C. Shirley, both of Hudson, Wis.

[73] Assignee: Nor-Lake Incorporated, Hudson, Wis.

[21] Appl. No.: 305,457

[22] Filed: Sep. 25, 1981

[51] Int. Cl.[3] ..... E04F 19/04

[52] U.S. Cl. ..... 52/238.1; 52/242

[58] Field of Search ..... 52/238, 241, 242, 287, 52/288, 716, 309.1, 238.1; 49/488, 490; 428/920, 921

[56] References Cited

U.S. PATENT DOCUMENTS

| | | | |
|---|---|---|---|
| 3,064,319 | 11/1962 | Miller | 49/488 |
| 3,160,280 | 12/1964 | Burch | 52/241 |
| 3,292,328 | 12/1966 | Lewis et al. | 52/238.1 |
| 3,363,390 | 1/1968 | Crane et al. | 52/716 |
| 3,744,199 | 7/1973 | Navarre | 52/241 |
| 3,854,246 | 12/1974 | McAllister | 49/488 |
| 3,861,103 | 1/1975 | Rasmussen | 52/241 |
| 3,983,290 | 9/1976 | Elcik | 428/921 |
| 4,130,972 | 12/1978 | Varlonga | 52/241 |

*Primary Examiner*—James L. Ridgill, Jr.

[57] ABSTRACT

A floor sealing gasket is described for use under wall panels in cooler constructions. The gasket comprises an elongate strip having a base with a generally flat bottom surface. A flexible downwardly projecting tip extends along at least one edge of the bottom surface of the base and generally parallel arms extend upwardly from each side of the base. The upper portion of each arm includes a flexible wing which is biased inwardly.

6 Claims, 2 Drawing Figures

FLOOR SEALING GASKET

FIELD OF THE INVENTION

This invention relates to means for attaching and sealing a floorless walk-in cooler to an existing floor. More particularly, this invention relates to sealing gaskets for use between the wall panels of a floorless walk-in cooler and the existing floor, concrete slab or other suitable surface.

BACKGROUND OF THE INVENTION

In the construction of some types of walk-in coolers the wall panels are not specifically constructed in such a manner as to closely conform to any floor surface irregularities. Consequently, where such surface irregularities exist there will be gaps of various sizes between the bottom edge of the wall panel and the floor. These gaps must be sealed in order to prevent warm air from entering the cooler, and cold air in the cooler from escaping. Although it has been known, for example, to fasten a vinyl strip to the floor and then to the wall panels, if there are any floor surface irregularities the vinyl strip will be pulled loose from the floor or the wall panel, thus leaving an undesirable gap between the bottom of the wall panel and the floor or the wall panel and the vinyl strip.

SUMMARY OF THE INVENTION

The present invention provides a floor sealing gasket which eliminates gaps between the bottom edge of wall panels and the floor even where there are surface irregularities in the floor. In accordance with the invention there is provided a floor sealing gasket comprising an elongate strip which is conformable to surface irregularities of a floor. The bottom surface of the gasket is generally flat. Along at least one (and preferably both) of the edges of the bottom surface of the gasket there is a flexible tip which is normally biased downwardly so that it will be urged tightly against the floor when the gasket is fastened to the floor. Extending upwardly from the base of the gasket are parallel arms which extend along the entire length of the gasket strip. The upper end of each arm includes a flexible wing which curves slightly inwardly toward the space between the arms. When wall panels are positioned in the gasket the flexible wings bear against the inner and outer surfaces of the panel in order to form a seal to prevent air from passing from one side of the wall to the other side.

BRIEF DESCRIPTION OF THE DRAWINGS

The invention is described in more detail hereinafter with reference to the accompanying drawings wherein like reference characters refer to the same parts throughout the several views and in which.

DETAILED DESCRIPTION OF THE INVENTION

Figure 1:
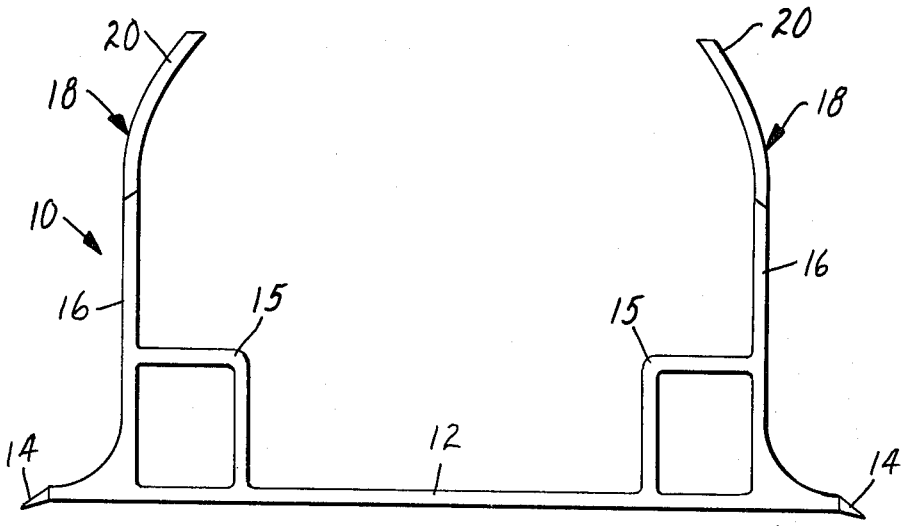
FIG. 1 is an end view of the floor sealing gasket of the invention.

In the drawings there if shown floor sealing gasket 10 which is an elongate strip having base 12 which is generally flat. Along each edge of base 12 there is a flexible tip 14 which is normally biased downwardly so that it will be urged tightly against the floor 30 and form a seal when the gasket is fastened to the floor for use. The base 12 conforms to the surface of floor 30, including an irregularity in such surface. The base 12 may be fastened to floor 30 by various conventional means, for example, by means of screws and anchors.

Extending upwardly from base 12 are two parallel arms 16 which extend along the full length of base 12. The upper end 18 of each arm includes a flexible wing 20 which curves slightly inwardly toward the space between arms 16. When wall panel 32 is positioned in gasket 10, flexible wings 20 are urged tightly against inner surface 34 and outer surface 36 of wall panel 32 so as to form a seal to prevent air from one side of panel 32 from passing to the other side thereof. It is not necessary to otherwise mechanically fasten wall panel 32 to sealing gasket 10. Even where there are irregularities in the surface of floor 30, arms 16 (including wings 20) will compensate for such irregularities and will maintain a proper seal between the wall panel and the floor.

Figure 2:
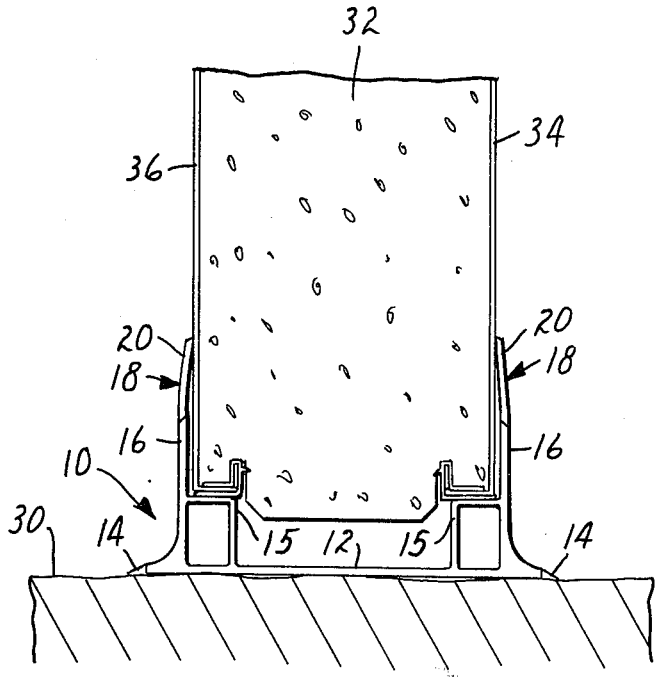
FIG. 2 is a cross-sectional view of the floor sealing gasket in use.

Sealing gasket 10 is preferably provided with interior shoulders 15 which extend along the full length of base 12 and which are each disposed adjacent to one of upwardly extending arms 16. The purpose of interior shoulders 15 (which are preferably hollow) is to provide a surface on which the lower edge of wall panel 32 is supported (as shown in FIG. 2). In this manner the lower edge of panel 32 and the base 12 of sealing gasket 10 define an air pocket therebetween.

Sealing gasket 10 is preferably made of a thermally non-conductive material such as plastic (e.g. polyvinylchloride) which is commonly available from various commercial sources. The tips 14 and wings 20 are made of flexible plastic whereas the other components may be made of rigid plastic. The sealing gasket is preferably formed by extrusion in accordance with conventional techniques whereby the rigid plastic portions and flexible plastic portions are extruded concurrently and become fused together, as shown in the drawings.

The sealing gasket of the invention has sufficient internal strength so as to be capable of supporting the weight of a wall panel, yet the gasket is itself light in weight and conformable to the surface of a substrate to which it is to be attached. The gasket is also easy to install. The rigid portions of the sealing gasket are capable of withstanding high impact at low temperatures (e.g. −50° F.) and the flexible portions remain flexible at the same low temperatures. The plastic is also resistant to abrasion and to normal cleaning solutions, is non-toxic, and has a smooth surface which is easily cleaned.

The sealing gasket of this invention is particularly useful when used in connection with wall panels having edge gaskets of the type described in copending application Ser. No. 299,403 filed Sept. 4, 1981 now U.S. Pat. No. 4,394,026 issued July 19, 1983, filed concurrently herewith, incorporated herein by reference.

What is claimed is:

1. A floor sealing gasket comprising an elongate strip having a base whose bottom surface is generally flat, wherein a flexible downwardly projecting tip extends along at least one edge of said bottom surface, said strip being conformable to surface irregularities of said floor, wherein generally parallel arms extend upwardly from each side of said base along the length thereof, wherein the upper portion of each arm includes a flexible wing which is biased inwardly, wherein said parallel arms are adapted to engage the outer major surfaces of a wall panel, wherein internal shoulders are disposed within said gasket, one of said shoulders being disposed adjacent one of said arms and the other of said shoulders being disposed adjacent the other of said arms, wherein said internal shoulders are adapted to support the bottom edge of said wall panel.

2. A floor sealing gasket in accordance with claim 1, wherein said base and said parallel arms are integral.

3. A floor sealing gasket in accordance with claim 1, wherein said gasket comprises plastic.

4. A floor sealing gasket in accordance with claim 3, wherein said base, parallel arms, and said wings are integral.

5. A floor sealing gasket in accordance with claim 4, wherein said plastic is polyvinylchloride.

6. In combination, a floor sealing gasket comprising an elongate strip having a base whose bottom surface is generally flat, wherein a flexible downwardly projecting tip extends along at least one edge of said bottom surface, said strip being affixed to a floor surface and conforming thereto, wherein generally parallel arms extend upwardly from each side of said base along the length thereof, wherein the upper portion of each arm includes a flexible wing which is biased inwardly, and wherein a wall panel having major side surfaces is received between said parallel arms, and wherein said flexible wing of each said arm bears against a respective major side surface of said panel, wherein internal shoulders are disposed within said gasket, one of said shoulders being disposed adjacent one of said arms and the other of said shoulders being disposed adjacent the other of said arms, wherein said internal shoulders are adapted to support the bottom edge of said wall panel.

* * * * *